United States Patent [19]

Bittar et al.

[11] Patent Number: 4,804,069

[45] Date of Patent: Feb. 14, 1989

[54] CONTIGUOUS FLOOR CHANNELING ELEVATOR DISPATCHING

[75] Inventors: Joseph Bittar; Kandasamy Thangavelu, both of Avon, Conn.

[73] Assignee: Otis Elevator Company, Farmington, Conn.

[21] Appl. No.: 157,542

[22] Filed: Feb. 12, 1988

[51] Int. Cl.[4] ..... B66B 1/20

[52] U.S. Cl. ..... 187/125; 187/127

[58] Field of Search ..... 187/125, 127, 128

[56] References Cited

U.S. PATENT DOCUMENTS

| | | | |
|---|---|---|---|
| 3,506,093 | 4/1970 | Suozzo et al. | 187/128 |
| 4,691,808 | 9/1987 | Nowak et al. | 187/125 |
| 4,735,294 | 4/1988 | Schroder | 187/125 X |

*Primary Examiner*—William M. Shoop, Jr.
*Assistant Examiner*—W. E. Duncanson, Jr.

[57] ABSTRACT

An elevator system contains a group of elevator cars. A group controller contains signal processing means for controlling the dispatching of the cars from a main floor or lobby in relation to different group parameters. During up-peak conditions, each car is dispatched from the main floor to an individual plurality of contiguous floors, defining a "sector". Sectors are contiguous. The number of sectors may be less than the number of cars. Floors that constitute a sector assigned exclusively to a car are displayed on an indicator at the lobby. Sectors and cars are selected for assignment in a cyclical or round-robin sequence. If the next car selected is not available for assignment, another car is selected. If no car calls are made to the floors in the sector that is assigned to a car, the next sector is selected. The floors in the sector assigned to a car are displaced to direct passengers to the car. If car calls to the floors are not made, the car doors are closed and a new sector is assigned to the car according to the sequence.

12 Claims, 3 Drawing Sheets

CONTIGUOUS FLOOR CHANNELING ELEVATOR DISPATCHING

TECHNICAL FIELD

This invention pertains to dispatching elevator cars in an elevator system containing a plurality of cars providing group service to a plurality of floors in a building during up-peak conditions.

BACKGROUND ART

In a building having a group of elevators, elevator interfloor traffic and traffic from the lobby or main floor (e.g. lobby) to upper floors varies throughout the day. Traffic demand from the main lobby is manifested by the floor destinations entered by passengers (car calls) on the car call buttons. Traffic from the lobby is usually highest in the morning in an office building. This is known as the "up-peak" period, the time of day when passengers entering the building at the lobby mostly go to certain floors and when there is little if any "interfloor" traffic (few hall calls). Within the up-peak period, traffic demand from the lobby may be time related. Groups of workers for the same business occupying adjacent floors may have the same starting time but different from other workers in the building. A large influx of workers may congregate in the lobby awaiting elevator service to a few adjacent or contiguous floors. Some time later, a new influx of people will enter the lobby to go to different floors.

During an up-peak period, elevator cars that are at the lobby frequently do not have adequate capacity to handle the traffic volume (the number of car calls) to the floors to which they will travel. Some other cars may depart the lobby with less than their maximum (full) loads. Under these conditions, car availability, capacity and destinations are not efficiently matched to the immediate needs of the passengers. The time it takes for a car to return to the lobby and pick up more passengers (passenger waiting time) expands when these loading disparities are present.

In the vast majority of group control elevator systems in use, waiting time expansion is traceable to the condition that the elevator cars respond to car calls from the lobby without regard to the actual number of passengers in the lobby that intend to go to the destination floor. Two cars can serve the same floor, separated only by some dispatching interval (the time allowed to elapse before car is dispatched). Dispatching this way does not minimize the waiting time in the lobby because the car load factor (the ratio of actual car load to its maximum load) is not maximized and the number of stops made before the car returns to lobby to receive more passengers is not minimized.

In some existing systems, for instance U.S. Pat. No. 4,305,479 to Bittar et al on "Variable Up-Peak Elevator Dispatching", assigned to Otis Elevator Company, the dispatching interval from the lobby is regulated. Sometimes, this means that a car, in a temporary dormant condition, may have to wait for other cars to be dispatched from the lobby before receiving passengers who then enter car calls for the car.

To increase the passenger handling capacity of time, the number of stops that a car can make may be limited to certain floors. Cars, often arranged in banks, may form a small group of cars that together serve only certain floors. A passenger enters any one of the cars and is permitted to enter a car call (e.g., pressing a button on the car operating panel) only to the floors served by the group of cars. "Grouping", as this is commonly called, increases car loading, improving system efficiency, but does not minimize round trip time back to the lobby. The main reason is that it does not force the car to service the lowest possible floor with the minimum number of stops before reaching that floor.

In some elevators, cars are assigned floors based on car calls that are entered from a central location. U.S. Pat. No. 4,691,808 to Nowak et al on "Adaptive Assignment of Elevator Car Calls", assigned to Otis Elevator Company, describes a system in which that takes place, as does Australian Pat. No. 255,218 granted in 1961 to Leo Port. This approach directs the passengers to cars.

DISCLOSURE OF THE INVENTION

According to the invention, passengers may only reach a group of contiguous floors by using one car in a group of cars at a specified time. This assignment is made on a cyclical basis. The assignment is removed if during a cycle car calls to those floors are not entered for that car in a preset time interval. When an assignment is removed, the doors are closed and then reopened when a new assignment of floors is made. The floors exclusively assigned to a car are indicated to passengers on the floor. When the assignment is removed, the indication is removed.

According to the invention, in a building having a plurality (X) of contiguous floors above or below a main floor, for instance the floors above a lobby, during the "up-peak period" the dispatching sequence follows a scheme by which the floors are arranged in N contiguous sectors (N being an integer less than X). N or more cars are used to serve the sectors, but each sector is assigned (served) at any one time by only one of the cars. The floors in the sector assigned to (served by) a car are displayed on a indicator at the lobby. Once a car responds to the car calls for floors in the sector it is typically returned to the lobby for assignment once again to a sector. Selection of a sector for assignment is made according to a preset sequence, as is the selection of the next car for assignment. Cars are selected by that sequence as they approach a committable position for stopping at the lobby. According to one aspect of the invention, sectors and cars are selected according to numerical order, in effect a "round-robin" selection. If car calls are not made to floors in the sector after the car doors are closed, the doors then reopen when the car is again assigned to the next sector that is selected. The floors in that sector are then displayed on the indicator.

BEST MODE FOR CARRYING OUT THE INVENTION

Figure 1:
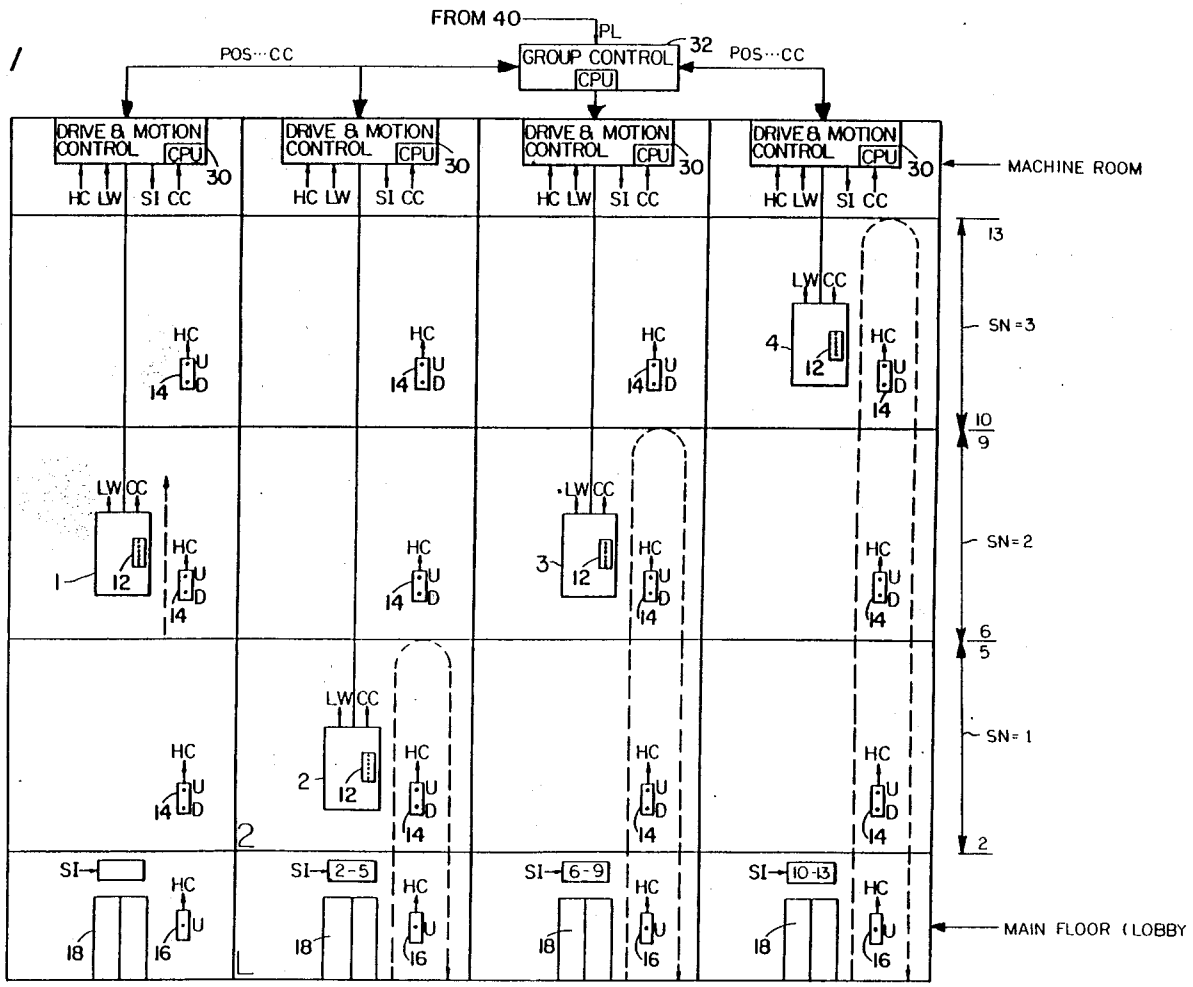
FIG. 1 is a functional block diagram of an elevator system consisting of a four car "group" serving thirteen floors.

In FIG. 1, four elevator cars 1–4, which are part of a group elevator system, serve a building having a plurality of floors. For the purpose of this discussion, the building has thirteen floors above a lobby. Each car 1–4 contains a car operating panel 12 through which a passenger makes a car call to a floor by pressing a button, producing a signal CC, identifying the floor to which the passenger intends to travel. On each of the floors there is a hall fixture 14 through which a hall call signal HC is provided to indicate the intended direction of travel by a passenger on the floor. At the lobby L, there is also a hall call fixture 16, through which a passenger calls the car to the lobby. The depiction of the group in FIG. 1 is intended to illustrate the selection of cars during an up-peak period, according to the invention, at which time the floors 2–13, above the main floor, are divided into three sectors, each containing four floors. The floors in the building are divided into three sectors SN, each containing four floors. Each of the sectors, which are contiguous, are served by only one of the four cars 1–4 at any time, an operation explained in more detail below in context with the flow charts forming FIGS. 2A–2B and leaving one car free, which is contemplated to be the preferred application of the invention. However, the building may be divided into four sectors, in which case all the cars can be used to serve the sectors.

At the lobby, and located above each door 18, there is a service indicator SI for a car, which shows the temporary selection of floors exclusively reachable from the lobby by a car based on the sector assigned to the car. That assignment changes throughout the up-peak period, as explained below, where it is also said that each sector is given a number SN and each car is given a number CN. In the case of car 2, CN=2, it is assigned to serve the sector 1, SN=1. Car 3, CN=3, serves the sector 2, SN=2. Car 4, CN=4, serves sector 3, SN=3. Car 1, CN=1, is momentarily not assigned to a sector. The service indicator SI for car 2 displays floors 2–5, the floors in sector 1, to which that car exclusively provides service from the lobby—but for one trip from the lobby. Car 3 similarly provides exclusive service to sector 2 consisting of floors 6–9, and the indicator for car 2 shows those floors. The indicator for car 4 indicates floors 10–13, the floors in sector 3. The service indicator for the car 1 is not illuminated, showing that it is not serving any sector at this particular instant of time during the up-peak channeling sequence reflected in FIG. 1. Car 1, however, may have one of the sectors assigned to it as it approaches the lobby at a subsequent time, depending on the position of the other cars at that time and the current assignment of sectors to cars. As explained below, the assignment of sectors to cars follows a sequence that follows the numerical order of the cars and sectors, as a result of which, sectors are assigned and cars are selected for assignment as they reach the committable position for the lobby in a cyclical pattern, producing a "round-robin" assignment over time.

Each car 1–4 will only respond to car calls that are made in the car from the lobby to floors that coincide with the floors in the sector assigned to the car. The car 4, for instance, will only respond to car calls made at the lobby to floors 10–13. It will take passengers from the lobby to those floors (provided car calls are made to those floors) and then return to the lobby empty, unless it is assigned to a hall call which may be done using sequences described in companion application Ser. No. 157,543 "Contiguous Floor Channeling with up hall call Elevator Dispatching" Thangevelu et al. As noted, this mode of dispatching is used during an up-peak period. At other times of the day (when there is more "interfloor" traffic) different dispatching routines may be used to satisfy interfloor traffic and traffic to the lobby (it tends to build after the up-peak period, which occurs at the beginning of the work day). For example, the dispatching routines shown in these U.S. patents (the "Bittar patents", all assigned to Otis Elevator Company) may be used at other times in whole or in part in an overall dispatching system in which the routines associated with the invention are accessed during the up-peak condition: U.S. Pat. No. 4,363,381 to Bittar on "Relative System Response Call Assignments", U.S. Pat. No. 4,323,142 on "Dynamically Reevaluated Elevator Call Assignments".

As in other elevator systems, each car 1–4 is connected to a drive and motion control 30. Each of these motion controls 30 is connected to a group control 32. Although it is not shown, each car's position in the building would be served by the controller through a position indicator as shown in the previous patent to Bittar et al. The controls 30,32 contain a CPU (central processing unit or (signal processor) for processing data from the system. A group controller 32 that, using signals from the drive and motion controls 30, sets the sectors that will be served by each of the cars. Each motion control 30 receives the HC and CC signals and provides a drive signal to the service indicator SI. Each motion control also receives data from the car that it controls on the car load LW. It also measures the lapsed time while the doors are open at the lobby (the "dwell time", as it is commonly called). The drive and motion controls are shown in a very simplified manner herein because numerous patents and technical publications showing details of drive and motion controls for elevators are available. It is assumed therefore that the CPUs in the controllers 30,32 are programmable to carry out the routine described herein to effect the dispatching operation of this invention at a certain time of day or under selected building conditions, and it is also assumed that at other times the controllers are capable of resorting to a different dispatching routine, for instance, the routines shown in the aforementioned Bittar patents.

Owing to the computing capability of the CPUs, this system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and lobby traffic may also be analyzed through signals LW, from each car, that indicates the car load. Actual lobby traffic may also be sensed by using a people sensor (not shown) in the lobby. U.S. Pat. No. 4,330,836 to Donofrio et al on an "Elevator Cab Load Measuring System" and U.S. Pat. No. 4,303,851 to Mottier on a "People and Object Counting System", both assigned to Otis Elevator Company, show approaches that may be employed to generate those signals Using such data and correlating it with the time of day and the day of the week and the actual entry of car calls and hall calls, a meaningful demand demograph can be obtained for allocating floors to the sectors throughout the up-peak period in accordance with the invention by using a signal processing routine that implements the sequences described on the flow chart comprising FIGS. 2A–B in order to minimize the waiting time from the lobby.

Figure 2A:
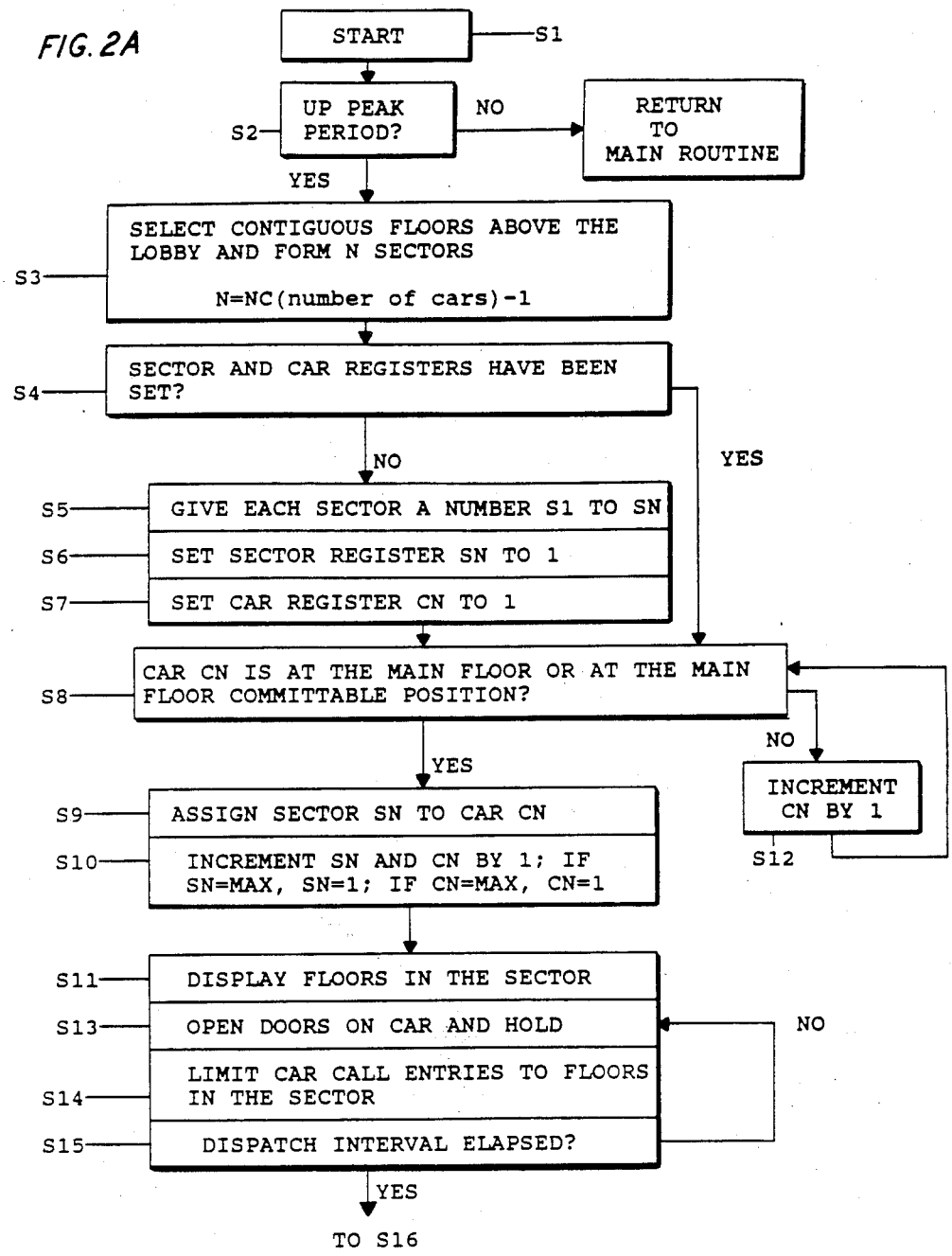
FIGS. 2A–B is a flow chart that shows a dispatching routine according to the present invention.
Figure 2B:
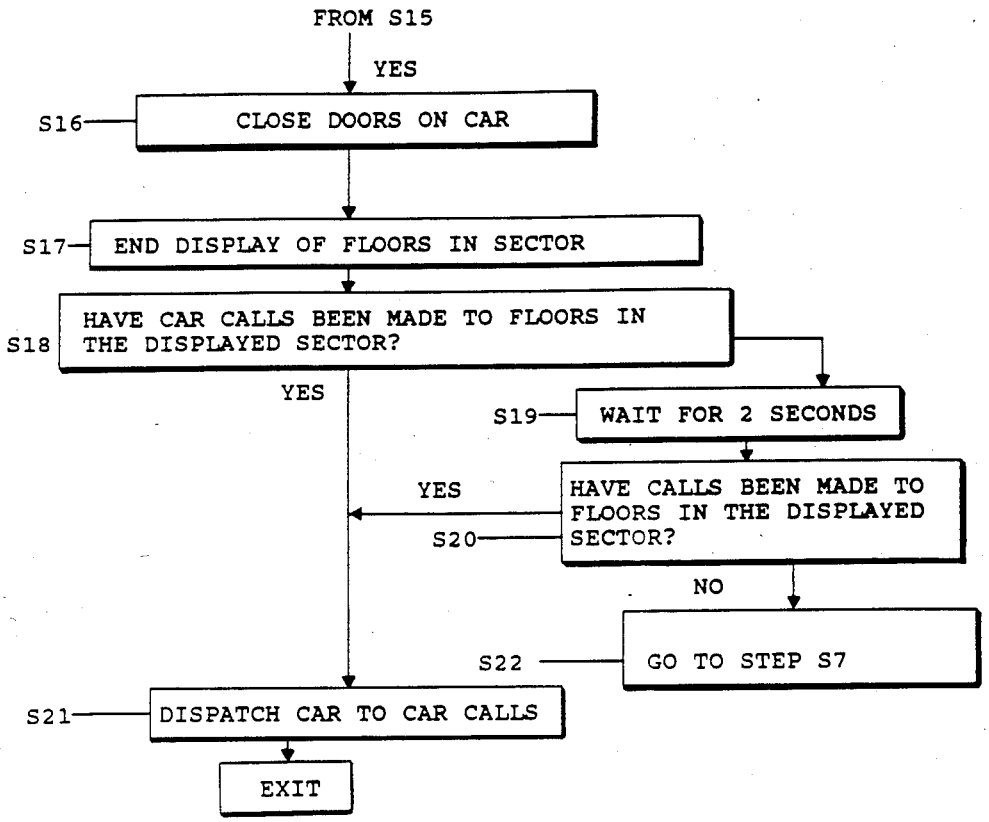

In discussing the dispatching of cars to sectors using the assignment scheme or logic illustrated in FIGS. 2A–B, it is assumed (for convenience) that the elevator cars 1–4 are moving throughout the building, eventually returning to the lobby (main floor serving upper floors) to pick up passengers. According to FIGS. 2A–B, which shows a flow chart for controlling the assignment of sectors and the dispatching of cars according to the present invention on a rapidly occurring cyclical basis, this "up-peak" channeling dispatching routine begins at step S1 and then at step S2 a test is made to determine whether an up-peak condition exists, for instance, it is the morning on a business day. If the answer to step S2 is in the negative (no), the subroutine exits from the channeling routine to a main elevator control dispatching routine such as what is shown in the previously mentioned Bittar patents. If the answer to step S2 is in the affirmative (yes), step S3 proceeds in which the sectors are formed of contiguous floors above the lobby. In step S3, the number of sectors is "N", which is equal to the number of cars (NC) minus one. For instance, in FIG. 1 there are three sectors and four cars. As noted previously, the number of sectors can equal the number of cars, but having more cars than sectors reduces the interval between cars that successively serve the same sector. Hall call assignments may be made according to the teachings of the Bittar patents. It may be made using the techniques described in companion application "Contiguous Floor Channeling with Up Hall Call Elevator Dispatching" by Bittar et al, also assigned to Otis Elevator Company (Project No. OT-725).

In step S4, a test is made that determines if the up-peak channeling routine has been previously entered, which would have resulted in the performance of step S5, in which each sector is given a number (an integer), and in the performance of step S6, in which a sector register, in the group control, is set to 1, presumably the lowest SN, and in the performance of step S7, in which a similar car register is set to the lowest CN, presumably 1. For the purposes of illustration, in FIG. 1, the sector serving floors 2–5 has an SN of 1 the sector serving floors 6–9 has an SN of 2 and the sector serving floors 10–13 has an SN of 3. Car 1 would have a CN of 1, car C2 a CN of 2, car C3 a CN of 3 and car C4 a CN of 4. CN and SN can be assumed to be initialized at one. The sequences illustrated by the flow chart attempt to assign a sector to car 1, starting with sector 1. In the preferred embodiment, one using a modern CPU, the selection process takes place many times per second.

If the answer at S4 is affirmative, step S8 is entered. Step S8 is also entered after the registers are initialized. In step S8, the test is whether the car with the number (CN) then under consideration is at the committable position, a position at which the car is ready to initiate stopping at the lobby. If the answer to this test is negative (in FIG. 1 it would be negative because car 1 is moving away), CN is increased by one unit in step S12, meaning that the assignment attempt now shifts to car 2. For the purpose of illustration, assume that car 2 is descending at the indicated position. This will yield an affirmative answer at S8, causing assignment of the sector 1 (containing floors 2–5) to car 2, that taking place in step S9. In step S10 both SN and CN are incremented by one, but SN or CN have reached their respective maximum, something that would happen after each car and each sector is assigned. When that happens, SN and CN are set to one once again (on an individual basis). This sequence of operations has the effect of causing the sectors to be assigned to the cars in a numerically cycling pattern.

In step S11, the floors in the sector assigned to a car in the previous sequence are displayed on the lobby or main floor on the "service indicator" SI. Step S13 commands the opening of the car doors when the car reaches the lobby and holding the doors in the open position to receive passengers, who presumably enter the car intending to enter car calls on the car call buttons (on the car operating panel) to go to the floors appearing on the service indicator. Car calls only to those floors are limited by step S14. In step S15, it is determined if the dispatching interval has elapsed. If not (a negative answer) the routine cycles back to S13, keeping the doors open. Once the dispatching interval passes (producing an affirmative answer at S15), the doors are closed at step S16. The service indicator is then deactivated at step S17 (until the next sector is assigned to the car). Step S18 determines if "permissible" car calls (car calls to floors in the sector) have been made. Since a sector is assigned to a car without regard to the entry of car calls, there is no demand for the sector at the particular time that the car is at the lobby ready to receive passengers (when the sector is assigned to the car at the main floor or lobby). Hence, if permissible car calls have not been made, the routine goes through step S19, where it waits for a short interval (e.g. 2 seconds) and repeats the test of S18 (at step S20). If the answer is still negative, the routine moves back to step S8 on the instruction at step S22. The routine then considers the assignment of the next numerical sector to the next numerical car at the committable position. Since a numerical sequence is followed, conflicts between cars at the committable position at the same time does not encumber the assignment process. The previous sector will be assigned again in another cycle to another car, by which time the car call requests may materialize allowing the car to be dispatched to the requested floors.

The size of the sectors (number of floors in the sector) is fixed in the foregoing description, but the invention may be applied to a system in a way that adjusts the size of the sectors. The size may be changed based on actual or anticipated traffic patterns in the building. For instance, the number of floors in a sector may be enlarged or reduced so that each sector has roughly equal passenger load from the lobby or main floor. The number of floors in the sectors does not have to be same, although that has been shown, but only for convenience in explaining the invention. Changes in sector size can be made based on measured passenger density in the lobby and correlating it with expected car call requests at the particular time that the assignment of sectors are made in a subroutine cycle.

While the foregoing is a description of the best mode for carrying out the invention and also describes variations and modifications that may be made to the invention in whole or in part, it will be understood by one skilled in the art that other modifications and variations may be made to the apparatus and the programs described herein without departing from the true scope and spirit of the invention.

We claim:

1. An elevator system comprising a plurality of cars for transporting passengers from a main floor to a plurality of contiguous floors above or below the main floor; car call means for entering car call for each car; indicating means at the main floor for indicating the intended floor stops for a car; car motion control means for moving each car; car position means for providing a position signal indicating the location of the car; door control means for controlling the opening and closing of the doors on each car; and a controller for providing signals that control the operation of the motion control, the door control means and the indicating means in response to the position signals and car calls, characterized in that:

said controller comprises signal processing means providing signals:

for dividing the floors in the building into a plurality of sectors, less than or equal to the plurality of cars, each sector comprising one or more contiguous floors, the sectors being contiguous with each other;

for assigning a sector exclusively to one of the cars during a cycle of a cyclical assignment sequence that assigns a sector exclusively to one car during one cycle according to a preset sector order and a preset car order as a car approaches a particular position relative to the main floor for receiving passengers at the main floors;

for allowing a car to move away from the main floor in response to car calls only if the car calls are to floors in the sector assigned to the car;

for indicating on the indicating means the floors in a sector assigned to a car; and for assigning a different sector to said one car if car calls meeting preset criteria are not made to floors in the sector after the sector is assigned to the car.

2. An elevator according to claim 1, characterized in that said sequence comprises assigning each car and sector a number and following the numerical order of the numbers when assigning sectors to cars and selecting the cars for said assignment as each car reaches a committable position for the main floor.

3. An elevator according to claim 1 or 2, characterized in that said criteria comprises the determination that no car calls have been made for a certain time interval after the doors on the car are closed and said processing means includes means for providing signals for causing the doors to close upon said determination and deactivating the indicating means until a subsequent assignment of a sector the car according to said sequence.

4. A method for dispatching elevators from the main floor to upper floors in a building in response to car calls made at the main floor and in response to the location of the cars, characterized by:

dividing the floors in the building into a plurality of sectors, adjacent the main floor, less than or equal to the plurality of cars, each sector comprising two or more contiguous floors, the sectors being contiguous with each other;

assigning a sector exclusively to one of the cars during a cycle of a cyclical assignment sequence that assigns sectors according to a preset sector order and a preset car order as a car approaches a particular position relative to the main floor;

allowing a car to move away from the main floor in response to car calls only if the car calls are to floors in the sector assigned to the car;

indicating at the main floor the floors in a sector assigned to a car; and assigning a different sector to said one car if car calls meeting preset criteria are not are not made to floors in the sector after the sector is assigned to the car.

5. A method according to claim 4, characterized in that said sequence comprises assigning each car and sector a number and following the numerical order of the numbers when assigning sectors to cars and selecting cars for said assignment as each car reaches the committable position for the main floor.

6. A method according to claim 4 or 5, characterized in that said criteria comprises the determination that no car calls have been made for a certain time interval after the doors on the car are closed and said processing means includes means for providing signals for causing the doors to close after a preset time has elapsed from the time the doors were opened at the main floor and deactivating the indicating means until the subsequent assignment of a sector the car according to said sequence.

7. An elevator controller for controlling the assignment of car calls among a plurality of elevator cars serving a plurality of floors in a building in response to car calls made at a main floor to contiguous floors above or below the main floor, for controlling the operation of the doors on each car and for controlling an indicator at the main floor that is capable of indicating the floors to which each car may travel, characterized by signal processing means for providing signals:

for dividing the floors in the building into a plurality of sectors, adjacent the main floor, less than or equal to the plurality of cars, each sector comprising two or more contiguous floors, the sectors being contiguous with each other;

for assigning a sector exclusively to one of the cars by following a cyclical assignment sequence that assigns sectors according to a preset sector order and a preset car order as a car approach a particular position relative to the main floor;

for allowing a car to move away from the main floor in response to car calls only if the car calls are to floors in the sector assigned to the car;

for indicating on the indicating means the floors in a sector assigned to a car;

for assigning a different sector to said one car if car calls meeting preset criteria are not are not made to floors in the sector after the sector is assigned to the car;

for opening and closing the doors on a car to which a sector is assigned to receive passengers from the main floor.

8. An elevator dispatcher according to claim 7, characterized in that in that said sequence comprises assigning each car and sector a number and following the numerical order of the numbers when assigning sectors to cars and selecting the cars for said assignment as each car reaches a committable position for the main floor.

9. An elevator according to claim 7 or 8, characterized in that said criteria comprises the determination that no car calls have been made for a certain time interval after the doors on the car are closed and said processing means includes means for providing signals for causing the doors to close after a preset time has elapsed from the time the doors were opened at the main floor and deactivating the indicating means until the subsequent assignment of a sector the car according to said sequence.

10. An elevator comprising a plurality of cars for transporting passengers from a main floor to a plurality of contiguous floors above or below the main floor; car call means for entering car calls for each car; indicating means at the main floor for indicating the intended floor stops for a car; car motion control means for moving each car; car position means for providing a position signal indicating the location of the car; door control means for controlling the opening and closing of the doors on each car; and a controller for providing signals that control the operation of the motion control, the door control means and the indicating means in response to the position signal and car calls, characterized in that:

said controller comprises signal processing means providing signals;

for dividing the floors in the building into a plurality of sectors, adjacent the main floor, less than or equal to the plurality of cars, each sector comprising two or more contiguous floors, the sectors being contiguous with each other; and for assigning a sector exclusively to one of the cars during each cycle of a cyclical assignment sequence that assigns sectors according to a preset sector order and a preset car order as a car approach a particular position relative to the main floor.

11. A method of for dispatching elevator cars in group elevator system to floors from a main floor comprising the steps:

indicating at the main floor a first plurality of contiguous floors that can be accessed by one car exclusively in response to car calls to those floors made for the car; and on a cyclical basis determining in a first cycle if car calls to said plurality of floors has been made within a predetermined time interval and, if not, closing the doors on the car, removing said indication of said first plurality of floors, indicating a second plurality of contiguous floors that can be served exclusively by said car during said first cycle and reopening the doors.

12. An elevator comprising a plurality of cars for transporting passengers from a main floor to a plurality of contiguous floors above or below the main floor; car call means for entering car calls for each car; indicating means at the main floor for indicating the intended floor stops for a car; car motion control means for moving each car; car position means for providing a position signal indicating the location of the car; door control means for controlling the opening and closing of the doors on each car; and a controller for providing signals that control the operation of the motion control, the door control means and the indicating means in response to the position signal and car calls, characterized in that:

said controller comprises signal processing means providing signals:

for indicating at the main floor a first plurality of contiguous floors that can be accessed by one car exclusively in response to car calls to those floors made for the car; and on a cyclical basis, for determining in a first cycle if car calls to said plurality of floors has been made within a predetermined time interval and, if not, closing the doors on the car, removing said indication of said first plurality of floors, indicating a second plurality of contiguous floors that can be served exclusively by said car during said first cycle and reopening the doors.

* * * * *